US006475342B1

(12) United States Patent
Retulainen

(10) Patent No.: US 6,475,342 B1
(45) Date of Patent: Nov. 5, 2002

(54) METHOD OF AND ARRANGEMENT FOR TREATING A FIBER WEB

(75) Inventor: Elias Retulainen, Kulju (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/535,382

(22) Filed: Mar. 24, 2000

Related U.S. Application Data

(63) Continuation-in-part of application No. 08/987,828, filed on Dec. 9, 1997, now abandoned.

(30) Foreign Application Priority Data

Dec. 10, 1996 (FI) ..... 964938

(51) Int. Cl.[7] ..... D21F 7/00

(52) U.S. Cl. ..... 162/206; 162/207; 162/358.5; 162/361; 162/375; 100/38; 100/151; 100/211

(58) Field of Search ..... 162/206, 207, 162/358.5, 375; 100/38, 151, 211

(56) References Cited

U.S. PATENT DOCUMENTS

| | | | | |
|---|---|---|---|---|
| 4,112,586 | A | 9/1978 | Lehtinen | 34/9 |
| 4,461,095 | A | 7/1984 | Lehtinen | 34/41 |
| 4,596,633 | A | 6/1986 | Attwood | 162/206 |
| 4,958,444 | A | 9/1990 | Rautakorpi et al. | 34/71 |
| 5,470,436 | A | 11/1995 | Wagle et al. | 162/207 |

FOREIGN PATENT DOCUMENTS

| | | |
|---|---|---|
| WO | 9514813 | 6/1995 |
| WO | 9611300 | 4/1996 |

*Primary Examiner*—Peter Chin
(74) *Attorney, Agent, or Firm*—Ladas & Parry

(57) ABSTRACT

The invention relates to a method and arrangement for moistening a substantially dry fiber web and subjecting the moistened web to heat and compression.

17 Claims, 1 Drawing Sheet

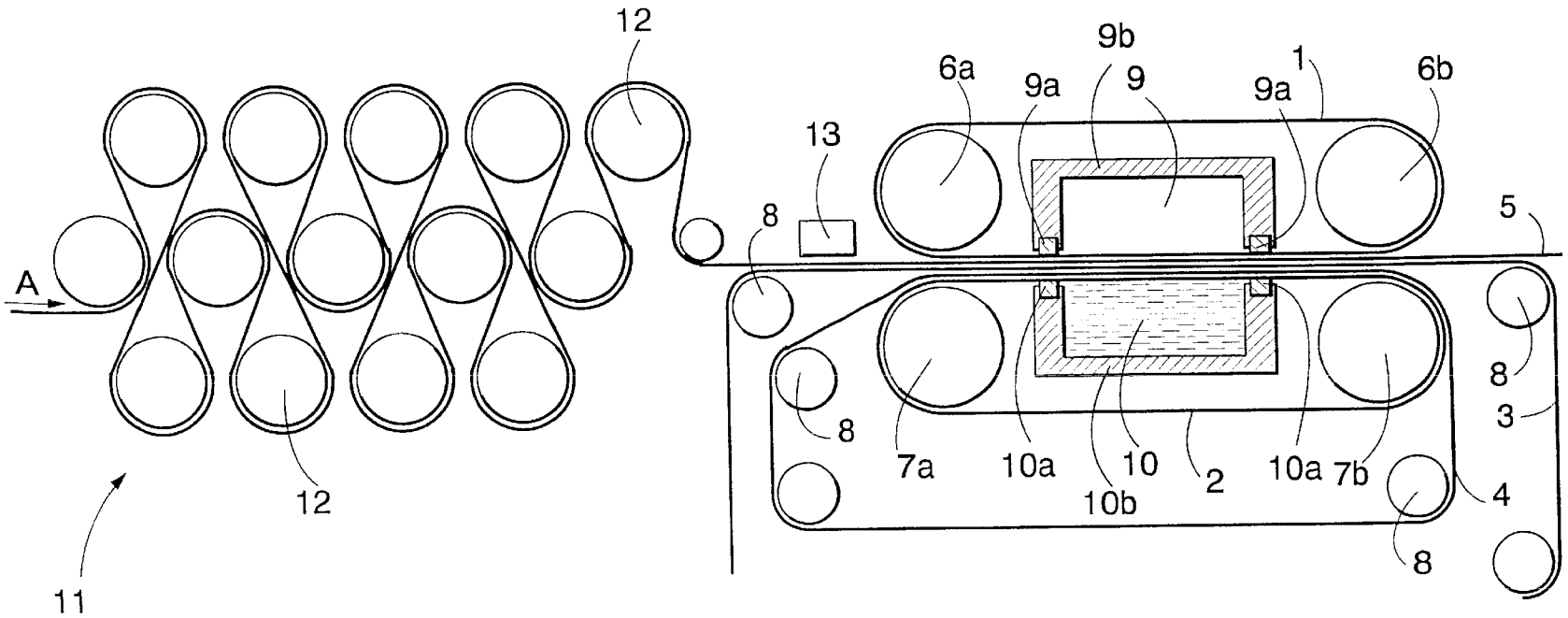
FIG.

METHOD OF AND ARRANGEMENT FOR TREATING A FIBER WEB

This application is a continuation-in-part of application Ser. No. 08/987,828 filed Dec. 9, 1997, now abandoned.

The invention relates to a method of treating a fiber web, in which method the fiber web is dried substantially dry and after that led to be treated by means of heat and compression.

The invention relates further to an arrangement for treating a fiber web, which arrangement comprises a drying apparatus for drying the fiber web substantially dry and means for treating the substantially dry fiber web by means of heat and compression.

If desired, a dried fiber web can be led to be calendered for polishing and smoothing the surface of the fiber web and for equalizing variations in web thickness. When calendering the fiber web, it is led through one or several compression zones or nips formed by rolls having a hard and smooth surface. The rolls can be heated, whereby the web is exposed, besides to compression, also to a heat treatment. The properties of the fiber web obtained from calendering depend very much on the surface pressure of the compression zone and on the number of nips. To provide a sufficient effect, many nips are often needed, which results in a structure comprising several rolls often mounted on each other. Such a structure is high and very inconvenient. Moreover, web conveying to the calender and from the calender forward in the process is difficult and complicated, because web threadings take place over long open gaps between these different parts of the process. In this way, the surface smoothness and gloss of the fiber web can be improved, but a treatment of this kind does not provide a sufficiently good final result in all cases, however.

The object of this invention is to provide a method and an arrangement, by means of which the surface treatment of the fiber web is well- and easily-implemented and can be included in a simple manner directly in the web making process, if desired.

The method of the invention is characterised in that at least one surface of the dry fiber web is arranged moist and led to an apparatus comprising two endless air-impermeable bands, first turning rolls, the first band being arranged to turn around the first turning rolls, and second turning rolls, the second band being arranged to turn around the second turning rolls, whereby the first band and the second band are arranged to run part of the way parallel to each other and whereby at least one band is heated.

Further, the arrangement of the invention is characterised in that the arrangement comprises at least one moistening apparatus for moistening at least one surface of the fiber web and an apparatus comprising two endless air-impermeable bands, first turning rolls, the first band being arranged to turn around the first turning rolls, and second turning rolls, the second band being arranged to turnaround the second turning rolls, whereby the first band and the second band are arranged to run part of the way parallel to each other, whereby at least one band is arranged to be heated by heating means and whereby the fiber web is led between the bands.

The essential idea of the invention is that a fiber web is dried substantially dry and led after that between two parallel bands moving in the same direction, whereby at least one of the bands is heated. Before the fiber web is led between the bands, the fiber web surface to be arranged against the heated band is moistened or the fiber web is dried one-sidedly in such a way that the moist or moistened surface of the fiber web bears against the heated band. The idea of a preferred embodiment is that the other band is cooled and a felt or wire is arranged particularly preferably between the fiber web and the cooled band.

An advantage of the invention is that the gloss and smoothness of the fiber web, the density of the web surface and/or some other property of the surface can be made extremely good. Further, by drying the fiber web throughout dry and by moistening the web surface to be arranged against the heated band, the moistening can be implemented in a controlled manner and the moisture profile of the fiber web can be made even. By cooling the other band, and especially, by arranging a felt or wire between the fiber web and the cooled band, it is possible to use for the treatment larger amounts of water, which can be removed at the treatment by means of the felt or wire and the cooled band, and the fiber web can be provided with a very good smoothness and gloss. Additionally, the apparatus constituted by said bands can easily be located in the process in such a way that no large open gaps remain in the travel direction of the web and no special web threading arrangements are needed. Moreover, in the solution of the invention, the risk of web breaks is small, because the fiber web is between the bands. This eliminates the roll damaging due to web breaks or the like occurring frequently in conventional calenders. The efficient treatment of the web surface according to the invention provides a more permanent smoothness, enduring for instance later moistening phases of printing. Moreover, the need of energy is reasonably small. In the solution of the invention, the smoothening surfaces are even more durable than in the conventional calendering method.

The invention is described in more detail in the attached FIGURE, showing schematically a sectional side view of an arrangement according to the invention in the travel direction of the web.

The FIGURE is a schematic sectional side view of an arrangement according to the invention in the travel direction of a web. The arrangement comprises an apparatus formed by endless bands that are impermeable to air, conduct heat well and are preferably made of metal: viz. a first band 1, i.e. an upper band, and a second band 2, i.e. a lower band, a fine wire or felt 3, a coarse wire 4 and the fiber web 5 running between those surfaces of the bands that face each other. The fiber web 5 moves in the direction indicated by arrow A. The first band 1 is arranged to turn around first turning rolls 6*a* and 6*b* located at the ends of the apparatus. Correspondingly, the second band 2 is arranged to turn around second turning rolls 7*a* and 7*b* also located at the ends of the apparatus below the first turning rolls 6*a* and 6*b*. The wires 3 and 4 are supported and guided by guide rolls 8. Since the pressure prevailing in the space between the bands 1 and 2 in the zone is usually different from the pressure prevailing outside or on the sides of the bands 1 and 2, seals are arranged on both sides of the apparatus between or at the edges of the bands 1 and 2, the seals preventing liquid or gas from moving. out of the space between the bands 1 and 2 sidewards, or vice versa. To effect vapour heating required for the treatment, the apparatus comprises a pressure chamber 9 situated above the first band 1. The first band 1 is sealed with seals 9*a* to the body 9*b* of the pressure chamber 9 so that the vapour in the pressure chamber 9 remains at a suitable pressure. Below the second band 2, there is a water chamber 10 containing water that cools the second band 2. At the edges of the water chamber 10, there are seals 10*a*, with which the second band 2 is sealed to the body 10*b* of the water chamber 10.

Before the fiber web 5 is led between the bands 1 and 2, the fiber web 5 is dried by a drying apparatus 11. The drying.

apparatus 11 may comprise for instance drying cylinders 12, against the surface of which the fiber web 5 is pressed with a felt or a drying wire for drying the fiber web 5 in a manner known per se. For the sake of clarity, FIG. 1 shows no wires by means of which the fiber web 5 is pressed against the drying cylinders 12 of the drying apparatus 11 and by means of which the fiber web 5 is guided in the drying apparatus. Further, the drying apparatus 11 may be any drying apparatus known per se.

The fiber web is dried in the drying apparatus 11 substantially dry, i.e. in such a way that the dry content of the fiber web 5 is over 70%. The dry content of the fiber web 5 is preferably 75 to 95%. Between the bands 1 and 2, the fiber web 5 is subjected to a compression pressure of between about 1 and about 10 bar, and therefore, the fiber web 5 must be dried in the drying apparatus 11 so dry that the fiber web 5 between the bands 1 and 2 endures compression and does not substantially lose its thickness.

Before the dry fiber web 5 is led between the bands 1 and 2, the fiber web 5 surface bearing against the first band. 1, which is the band 1 heated by the hot vapour of the pressure chamber 9, is moistened by a moistening apparatus 13. The moistening apparatus 13 may be any solution suitable for the purpose. The structure of said moistening apparatus is fully obvious to one skilled in the art, and therefore, it is not discussed any further in this connection. Because of the temperature of the first band 1, the water in the surface of the web 5 is vaporised and moves through the wires 3 and 4 in the direction of the second band 2. The second band 2 is cooled continuously with the water below it, whereby the vapour entering the band surface is condensed to water and removed together with the band 2 and the wire 4. Simultaneously, the fiber web 5 surface bearing against the heated band 1 is subjected to a treatment caused by heat and pressure, which makes the surface of the fiber web 5 very smooth and dense. If the surface of the band 1 is glossy, the fiber web 5 will also be glossy. By forming the surface of the band 1 in a desired manner, the surface of the fiber web 5 and the paper or board resulting from that can, instead of or in addition to being smoothed, be patterned in a desired way, the gloss can be removed and a mat finish can be provided or the surface can be worked in some other way. The solution according to the invention is a process, in which the fiber web 5 or its surface is plastized and worked by means of heat, moisture and compression in such a way that the structure of the surface of the heated band 1 is copied on the surface of the fiber web 5. If there is little moisture, more heat and compression are needed, and if the compression is low, more heat and moisture are needed.

The FIGURE and the relating specification are only intended to illustrate the idea of the invention. As regards the details, the invention may vary in the scope of the claims. Thus the drying can be performed in the drying apparatus 11 also one-sidedly and the fiber web 5 with one-sided dry substance can be led between the bands 1 and 2 in such a way that the moister surface of the fiber web 5 bears against the heated band 1. A separate moistening apparatus 13 is not absolutely necessary then. Further, no felt or wire is absolutely necessary between the fiber web 5 and the second band 2, if hardly any dehydration of the fiber web 5 is needed. Moreover, the second band 2 can also be heated in such a case, whereby both sides of the fiber web 5 could be moistened by the moistening apparatus 13, which would make both sides of the fiber web 5 glossy and smooth by means of the heated band. In such a case, the fiber web 5 shall naturally be arranged such that its middle part is able to receive the moisture coming from the surface of the fiber web 5.

The fiber web 5 to be treated can be an uncoated web or also a coated paper or board. The coating may be either pigment coating or other functional coating, such as siliconizing or emulsion coating. The drying of the coating can then take place simultaneously with the smoothening or other surface treatment according to the invention.

Moreover, it is not essential which pressure medium is used in the pressure chamber 9 and the water chamber 10. The pressure medium of the pressure chamber 9 can thus be for instance vapour, air, water, or hot combustion products of fuel. In addition to water, for instance air can also be used as the pressure medium of the water chamber 10.

In addition to the heating caused by the pressure chamber 9, the first band 1 can also be heated at other points. Further, the heating of the first band can also take place entirely outside the pressure chamber 9 or the heating can even take place without a pressure chamber 9.

Moreover, the second band 2 can also be cooled outside the water chamber 10 or the cooling can even be implemented without a water chamber 10. In addition to the pressure chamber 9 and the water chamber 10, the compression directed to the fiber web by the bands 1 and 2 can be provided by means of shoes, rolls or similar arrangements.

Further, the treatment of the fiber web can be implemented by means of on-line units according to the attached FIGURE or the fiber web 5 can be dried and reeled on a paper reel at first. The paper reel can be placed to a treatment unit separate from the rest of the paper machine and reeled off, the fiber web 5 can be moistened and led between the bands 1 and 2 for a treatment When a separate treating unit is used, an extra reeling must be performed, but possible problem situations turned up at the finishing treatment do not have any effect on the use of the rest of the paper machine. A further possible solution is to implement the treatment of the invention in connection with an off-line coating machine.

What is claimed is:

1. A method of treating a fiber web, the method comprising:

providing a substantially dry fiber web;

moistening at least one surface of the substantially dry fiber web;

leading the surface-moistened substantially dry fiber web to an apparatus comprising first and second endless air-impermeable bands arranged to turn around respective first and second turning rolls, wherein the turning rolls arrange the bands to run part way in parallel to each other for receiving the surface-moistened substantially dry fiber web subjected to a compression pressure between the parallel bands; and heating at least one of the first and second bands.

2. The method according to claim 1, wherein the leading leads the moistened surface of the surface-moistened substantially dry fiber web to bear against the heated band.

3. The method according to claim 1, and further comprising cooling one of the bands.

4. The method according to claim 3, and further comprising providing at least one felt or wire between the surface-moistened substantially dry fiber web and the cooled band while the moistened web is received between the bands.

5. The method according to claim 3, wherein the heating is by means of a pressure chamber and the cooling is by means of a water chamber.

6. The method according to claim 1, wherein the providing of the substantially dry fiber web comprises substantially drying the fiber web.

7. An apparatus for treating a fiber web, the apparatus comprising:

at least one moistening apparatus for moistening at least one surface of a substantially dry fiber web;

an apparatus comprising first and second endless air-impermeable bands, first turning rolls, the first band being arranged to turn around the first turning rolls, and second turning rolls, the second band being arranged to turn around the second turning rolls, wherein the turning rolls arrange the bands to run part way in parallel for receiving the surface-moistened substantially dry fiber web with the moistened surface subjected to a compression pressure between the parallel bands; and means for heating at least one of the bands.

8. The apparatus according to claim 7, wherein the moistened surface of the surface-moistened substantially dry fiber web bears against the heated one of the bands.

9. The apparatus according to claim 7, and further comprising means for cooling one of the bands.

10. The apparatus according to claim 8, and further comprising means for cooling one of the bands.

11. The apparatus according to claim 9, and further comprising at least one felt or wire on which the surface-moistened substantially dry fiber web is received between the bands, wherein the felt or wire is between the fiber web and the cooled band.

12. The apparatus according to claim 10, and further comprising at least one felt or wire on which the surface-moistened substantially dry fiber web is received between the bands, wherein the felt or wire is between the fiber web and the cooled band.

13. The apparatus according to claim 9, wherein the means for heating comprises a pressure chamber and the means for cooling comprises a water chamber.

14. The apparatus according to claim 10, wherein the means for heating comprises a pressure chamber and the means for cooling comprises a water chamber.

15. The apparatus according to claim 12, wherein the means for heating comprises a pressure chamber and the means for cooling comprises a water chamber.

16. A method of treating a fiber web, the method comprising:

providing a substantially dry fiber web;

moistening at least one surface of the substantially dry fiber web;

leading the surface-moistened substantially dry fiber web to an apparatus comprising first and second endless air-impermeable bands arranged to turn around respective first and second turning rolls, wherein the turning rolls arrange the bands to run part way in parallel to each other for receiving the surface-moistened substantially dry fiber web subjected to a compression pressure of between about 1 and about 10 bar between the parallel bands; and heating at least one of the first and second bands.

17. An apparatus for treating a fiber web, the apparatus comprising:

at least one moistening apparatus for moistening at least one surface of a substantially dry fiber web;

an apparatus comprising first and second endless air-impermeable bands, first turning rolls, the first band being arranged to turn around the first turning rolls, and second turning rolls, the second band being arranged to turn around the second turning rolls, wherein the turning rolls arrange the bands to run part way in parallel for receiving the surface-moistened substantially dry fiber web with the moistened surface subjected to a compression pressure of between about 1 and about 10 bar between the parallel bands; and means for heating at least one of the bands.

* * * * *